US005850461A

United States Patent [19]

Zelinka

[11] Patent Number: 5,850,461

[45] Date of Patent: Dec. 15, 1998

[54] DIAPHRAGM SUPPORT FRAMES FOR ACOUSTIC TRANSDUCERS AND METHOD OF ASSEMBLY

[75] Inventor: Thomas Richard Zelinka, Vancouver, Canada

[73] Assignee: Sonigistix Corporation, Vancouver, Canada

[21] Appl. No.: 943,272

[22] Filed: Oct. 3, 1997

[51] Int. Cl.[6] ..... H04R 25/00

[52] U.S. Cl. ..... 381/398; 381/408; 381/431

[58] Field of Search ..... 381/431, 408, 381/423, 398, 399; 181/171, 172; 29/594

[56] References Cited

U.S. PATENT DOCUMENTS

| | | | |
|---|---|---|---|
| 3,209,084 | 9/1965 | Gamzon et al. | 381/408 |
| 4,037,061 | 7/1977 | Recklinghausen | 381/408 |
| 4,468,530 | 8/1984 | Torgeson | 381/408 |
| 4,803,733 | 2/1989 | Carver et al. | 381/398 |
| 4,837,838 | 6/1989 | Thigpen et al. | 381/408 |

*Primary Examiner*—Huyen Le
*Attorney, Agent, or Firm*—Dowell & Dowell, P.C.

[57] ABSTRACT

A diaphragm mounting system for flat acoustic planar magnetic and electrostatic transducers which incorporates opposing frame sections, each of which defines a clamping or peripheral surface area and an internal or central area through which acoustic waves may pass from the diaphragm. The diaphragm is first placed on one frame section with zero plus tension. The second frame section includes a protruding ridge extending substantially along an inner edge of the central area which ridge defines a border for a sound producing area of the diaphragm. During assembly of the two frame sections, the ridge engages the diaphragm to place predetermined tension on the diaphragm as the sections are joined. In one embodiment, the profile of the ridge is shaped to provide predetermined biaxial tension in a diaphragm of generally rectangular shape.

18 Claims, 3 Drawing Sheets

DIAPHRAGM SUPPORT FRAMES FOR ACOUSTIC TRANSDUCERS AND METHOD OF ASSEMBLY

BACKGROUND OF THE INVENTION

1. Field of the Invention

This invention is generally directed to flat type acoustic transducers and, more particularly, to planar magnetic and other types of transducers including electrostatic transducers which may be utilized in loudspeakers, headphones, microphones and the like. More specifically, the present invention is directed to specially configured opposing frame sections for supporting and tensioning sound producing diaphragms in such transducers. Following placement of a diaphragm on one frame section, the frame sections are joined to place final tension on the sound producing diaphragm. Hence, the diaphragm of each transducer is retained within a frame under uniform tension throughout at least a sound producing area of the diaphragm.

2. History of the Related Art

In the field of planar magnetic acoustic transducers and related flat type transducers utilized for sound reproduction, the tensioning of sound producing diaphragms associated therewith is important to obtain uniform sound reproduction. The proper tensioning of a diaphragm within a support frame has created difficulty in manufacturing processes. In planar magnetic transducers, if sufficient diaphragm tensioning is not provided, the diaphragm may vibrate into one of the stators formed by spaced magnets mounted within a support frame in spaced relationship with respect to an electrical circuit applied to the diaphragm. Improper tensioning throughout the diaphragm also results in changes in the vibrational characteristics of the diaphragm throughout its "sound producing" or "active" area which is generally that area defined internally of the diaphragm support frame.

The assembly and mounting of the diaphragms of acoustic transducers of the planar magnetic type is discussed in the following prior art references. A basic approach is disclosed in U.S. Pat. No. 4,037,061 to von Recklinghausen wherein a polymer diaphragm is attached between two plastic support frames which engage and grip the edges of the diaphragm, after which the support structure is attached to magnet mounts. Precise control of tension is not discussed.

U.S. Pat. No. 4,837,838 to Thigpen discloses an acoustic transducer with the diaphragm assembled and fixed with tension to rigid frame members at the diaphragm perimeter such that, when assembled between magnet mounts, the diaphragm is spaced appropriately from the magnets for optimum operation. The invention describes the diaphragm as tensioned by well known methods prior to adhering to the frame, the frame being of sufficient strength to maintain the diaphragm tension. This method of precise tensioning prior to adhering to the diaphragm is sensitive to manufacturing variations and requires complex manufacturing equipment to implement in a mass production or automated process. Further, the initial area of the diaphragm may be significantly larger than the frame to minimize edge effects from the stretching apparatus, hence material is wasted. This extra waste limits the efficiency of a mass produced process using a roll of diaphragm material.

U.S. Pat. 4,468,530 to Torgenson discloses a manually tunable tension frame of plastic frame rails which is first movably affixed to a rigid front panel. A thin film is initially stretched to the yield point and then attached to the frame rails. Set screws are attached to frame rails and provide means to further adjust the tension. Such a process is labor intensive, increases manufacturing costs and is not suitable for mass manufacturing.

In an effort to overcome some problems associated with prior art diaphragm tensioning procedures, U.S. Pat. 4,803,733 to Carver et al. discloses a loudspeaker diaphragm mounting system and method which provides for a final tensioning of a diaphragm as opposing frame sections or components are assembled relative to one another. The patent discloses frame sections having opposing grooves formed in peripheral clamping surface portions thereof along which the diaphragm is normally seated so as to be spaced inwardly from a central area of the frame sections. A tubular yieldable tensioning member is positioned between the opposing grooves so that when the frame sections are assembled, a final tensioning will be provided by the yieldable tensioning member forcing the diaphragm into the groove associated with one of the frame sections wherein the tensioning member is cooperatively received in the opposing groove. In a varied embodiment, the patent to Carver et al. also discloses forming an integral outwardly extending ridge along the clamping surface portion of one of the frame sections which is cooperatively seated within the groove of the opposite frame section. During assembly, an outer edge portion of one of the frame sections is provided with an adhesive which initially holds the diaphragm thereto, thereafter, the frame sections are urged together thereby seating either the tensioning member or the integral ridge within the groove of the opposing frame section.

Unfortunately, this type of final assembly of the diaphragm to the frame sections does not necessarily provide uniform tensioning. During the application of the frame sections to one another, it is possible that imperfections in the mating surfaces of the frame sections, contaminants or improper alignment of the frame sections prior to final assembly may cause excessive static friction or other frictional forces which can result in a non-uniform final tensioning of the diaphragm between mating frame surfaces. Differences in the surface characteristics of the frame sections and the yieldable nature of the tensioning member can create different frictional forces along the length of the groove in which the diaphragm is seated. Further, binding of the frame sections can cause plastic deformation or breakage of the diaphragm. A further disadvantage of this type of structure is that contaminants or particles can lodge within the grooves created in the frame sections resulting in non-uniform tensioning of the diaphragm as the diaphragm is forced within the grooves during assembly.

In view of the foregoing, there remains a need to provide a process and structure for producing flat acoustic transducers, and especially those of the planar magnetic type, at relative lost cost, using fewer parts and with a low variance in acoustic uniformity of the finished products.

SUMMARY OF THE INVENTION

This invention is directed to support frames for the diaphragms of flat type acoustic transducers such as planar magnetic and electrostatic transducers wherein a sound producing diaphragm is secured between opposing frame sections so as to define an internal active or sound producing area in which the diaphragm is free to vibrate to produce acoustic waves. In one embodiment, an inner frame is utilized to support the diaphragm and the inner frame is thereafter supported within an outer frame to which magnets are placed for creating a magnetic field relative to electrical conductors on the diaphragm. In another embodiment, a single frame supports the diaphragm and also the magnets for creating the magnetic field on opposite sides of the electrical conductors.

In either embodiment, the frame supporting the diaphragm includes opposite sections each having an exterior peripheral border area. The diaphragm is initially secured to one frame section under zero plus tension. Zero plus tension is defined herein as a condition wherein the diaphragm is in a flat configuration, without wrinkles and under little or no tension. The opposing frame section includes an outwardly extending ridge which defines an inner edge of a central area thereof and which also defines the effective border of the sound producing or active area of the diaphragm when the frame sections are joined. During assembly, and as the second frame section is joined to the first frame section, the ridge associated with the second frame section will stretch or elongate and properly tension the diaphragm between the frame sections.

In some embodiments, the radius of curvature, taper or width of the tensioning ridge associated with the second frame section, and/or the inner edge of the first frame section, may be modified so that varying degrees of diaphragm elongation are created along the periphery of the sound producing area of the diaphragm. By way of example, a greater degree of diaphragm elongation may be desired along a longitudinal axis of a diaphragm as opposed to transverse thereto.

The frame sections of the present invention may have substantially any shape such as circular, oval or rectangular. When the frame sections of the invention are rectangular or of any other shape in which corners are created around the peripheral portion of the sound producing area of the diaphragm, a greater degree of diaphragm elongation is created at such corners when the diaphragm is uniformly stretched between the corners. Therefore, the tensioning ridge may also be shaped to reduce diaphragm deformation at the corners when the frame sections are assembled. Such selective diaphragm elongation, caused by preconfiguration of the tensioning ridge, allows uniform diaphragm tensioning regardless of frame shapes.

In a further embodiment, registry pins are secured to one of the opposing frame sections which are alignable with openings in the opposing frame section to ensure uniform alignment of the frame sections during high speed assembly.

It is the primary object of the present invention to provide a tensioning and support frame for use with flat type acoustic transducers wherein tensioning of a diaphragm supported by opposing frame sections is uniformly achieved along substantially any axis taken relative to the plane of the diaphragm as the frame sections are assembled to one another.

It is yet another object of the present invention to provide support frame members for supporting a diaphragm for use in a flat type acoustic transducer, and especially one of the planar magnetic type, wherein tensioning of the diaphragm is obtained by urging the diaphragm into an area defined by the central portions of the frame sections, thereby reducing the possibility of improper diaphragm tensioning caused by contaminants, irregularities of mating surface areas, or frictional forces often encountered in conventional structures.

It is yet a further object of the present invention to provide a method and apparatus for securing a diaphragm of a flat type acoustic transducer to a support frame wherein the tensioning of the diaphragm is accomplished as the diaphragm is assembled between mounting frame sections in such a manner that uniform tension may be created independent of the geometry of the borders.

DESCRIPTION OF THE PREFERRED EMBODIMENT

Figure 1:
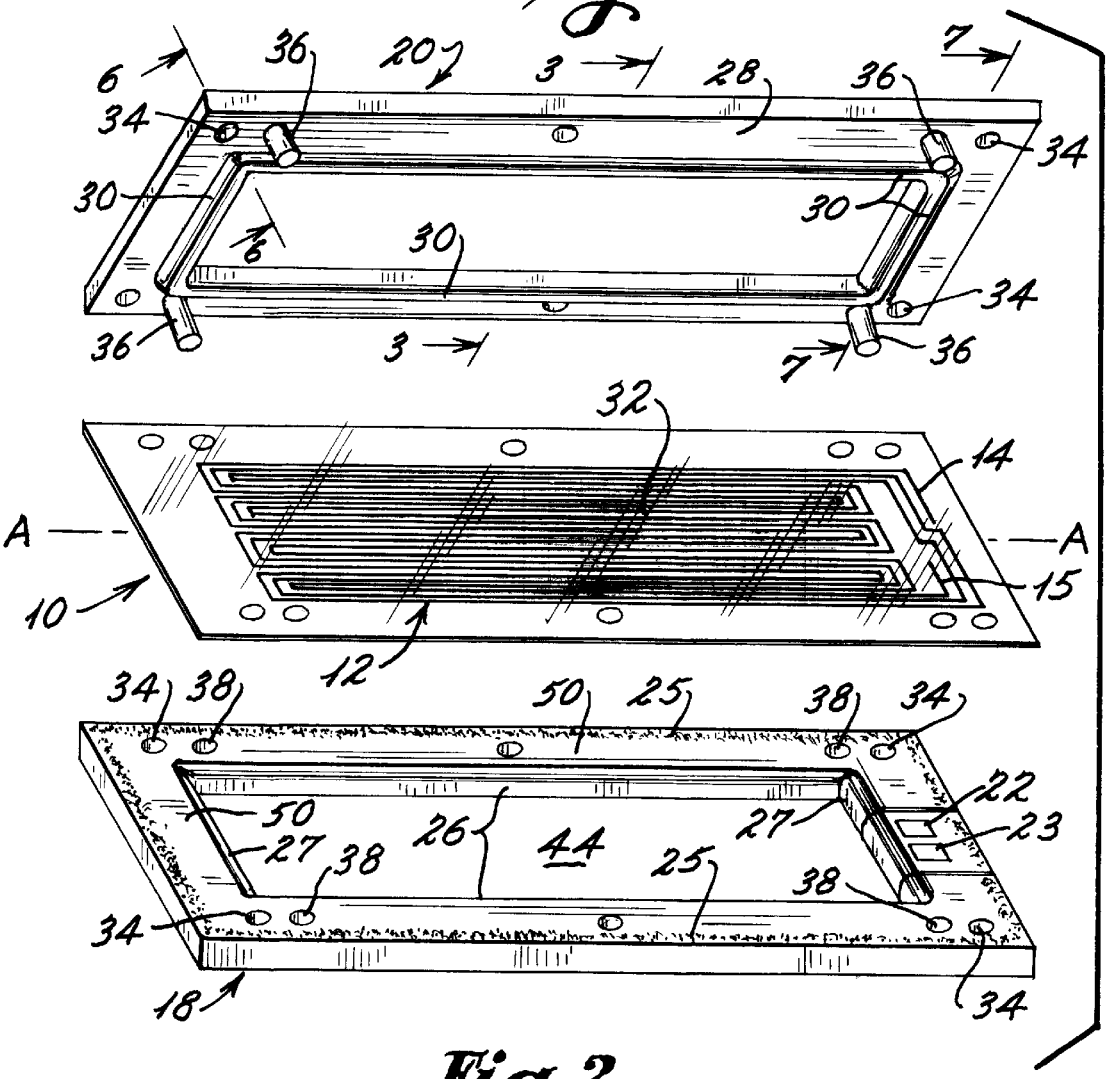
FIG. 1 is a perspective assembly view of a first embodiment of the present invention shown for use with a planar magnetic transducer and showing a central diaphragm having electrical conductor circuit runs applied thereto and wherein the diaphragm is to be retained between opposing frame sections in accordance with the teachings of the present invention.

With continued reference to the drawing figures and specifically as shown in FIG. 1, the first embodiment of the present invention is disclosed. In this embodiment, a diaphragm 10 for use with a flat type acoustic transducer, especially a planar magnetic transducer, is shown having a plurality of electrical conductor runs 12 applied thereon or etched thereto. The conductor runs are shown as extending generally longitudinally and parallel with respect to an elongated axis of the diaphragm shown at "A—A", however different patterns of conductor runs may be applied to the diaphragm depending upon the specific use for the transducer. The conductor runs end at positive and negative connections 14 and 15 which, when the diaphragm is assembled between opposing mounting frame sections 18 and 20, will be electrically connected with positive and negative terminals 22 and 23, respectively. The terminals 22 and 23 are connected to a suitable source of power supply such as an amplifier in a conventional manner.

The diaphragm 10 is normally manufactured of a thin flexible insulating plastic film such as Mylar™ which is generally less than 1 mil in thickness. There are, however, other materials known to those in the art that could be used such as paper, fabrics and the like.

Support frame section 18 is shown as having an upper peripheral border surface portion 25 which is substantially flat and which terminates at an inner edge defined by generally opposing longitudinal walls 26 and end walls 27. The upper or opposing frame section 20, shown in FIG. 1, has a peripheral border surface portion 28 which is complimentary in size to the border portion 25 of the opposing frame section 18. However, the upper frame section 20 includes an inner edge formed as a substantially continuous protruding tensioning ridge 30 which defines a border for an open area in which a sound producing area 32 of the diaphragm 10 is disposed when mounted between the frame sections. It should be noted that the electrical conductors 12 are positioned so as to be located within the sound producing area defined by the downwardly extending ridge 30 of the frame section 20. Although not shown in the drawing figures, it is preferred that the conductors are applied on the opposite side of the diaphragm with respect to the tensioning ridge.

Aligned openings 34 are provided in each of the frame sections 18 and 20 to receive suitable fastening elements, such as rivets or screws, which are used in some embodiments, to secure the frame sections in final assembled relationship to one another. In addition to the foregoing, the upper frame section 20 may include a plurality of registry pins 36 which are alignable with secondary openings 38 formed in the opposing frame section 18. The pins 36 are utilized to initially align the two frame sections when they are in a position generally shown in FIG. 2. The pins ensure proper tensioning of the diaphragm during the final assembly by accurately aligning the two frame sections when they are urged toward one another, preventing any relative lateral or sliding motion between the border surface portions 25 and 28 which would adversely affect uniform tensioning. The registry pins need not be integral with frame section 20 and other aligning and securing means may be used to assemble and retain the frame sections united to one another.

Figure 2:
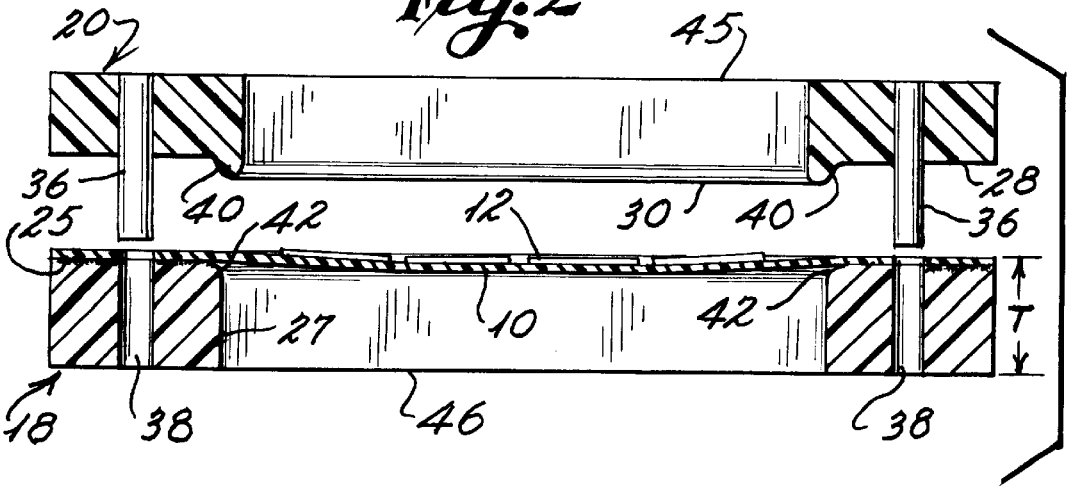
FIG. 2 is a cross-sectional assembly view showing the diaphragm of FIG. 1 being adhesively secured to the lower frame section in FIG. 1 and prior to the assembly of the upper frame section thereto.

With particular reference to FIG. 2, it should be noted that the ridge 30 of frame section 20 is aligned just to the inside of the edges 26 and 27 of the frame section 18. Further, the outer edge of the ridge 30 is slightly profiled having a rounded arcuate base configuration, as shown at 40, while the inner edges 26 and 27 of the frame section 18 are slightly curved, as shown at 42, whereby the two surface areas will not interfere directly with one another as the tensioning ridge is inserted within the opening 44 defined by the edges 26 and 27 of the frame section 18.

Figure 3:
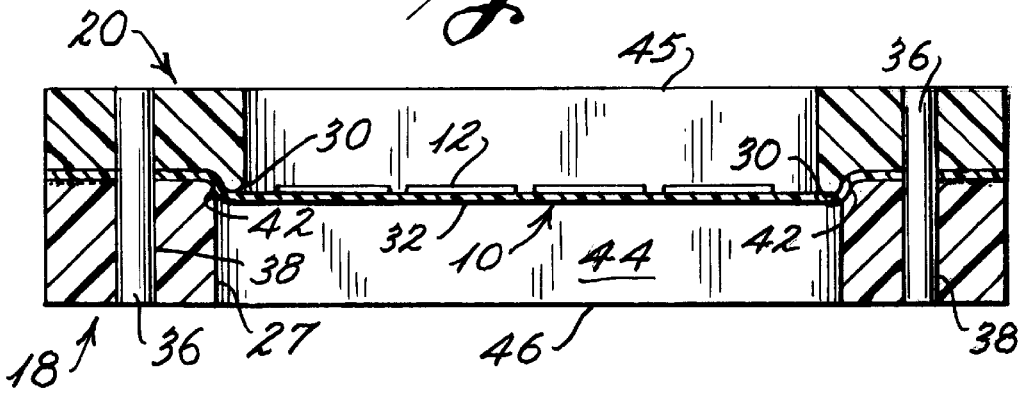
FIG. 3 is a cross-sectional view similar to FIG. 2 and taken along line 3—3 of FIG. 1 showing the final tensioning of the diaphragm by the upper frame section.

With specific reference to FIG. 1, it should be noted that the thickness "T" of the frame section 18 is slightly greater than that of frame section 20. This is to ensure that when frame section 20 is initially aligned and then lowered into contact with frame section 18, as shown in FIG. 3, the conductors of the diaphragm will be equally spaced between the upper and lower surfaces of the united frame as shown at 45 and 46, respectively. This is important to ensure that when the frame having the diaphragm secured therein is mounted within an outer frame (not shown) to which magnets are supported on opposite sides of the diaphragm, the conductor circuit is generally equally spaced between the magnetic fields created by the opposing sets of magnets so that an equal push-pull effect is created on opposite sides of the diaphragm. The dimensions of the ridge 30 are predetermined so that the diaphragm is urged to the necessary position between the upper and lower surfaces of the combined frame. It should be noted that the present invention may be used with magnets mounted on any one side of the diaphragm and with magnets mounted asymmetrically.

Figure 6:
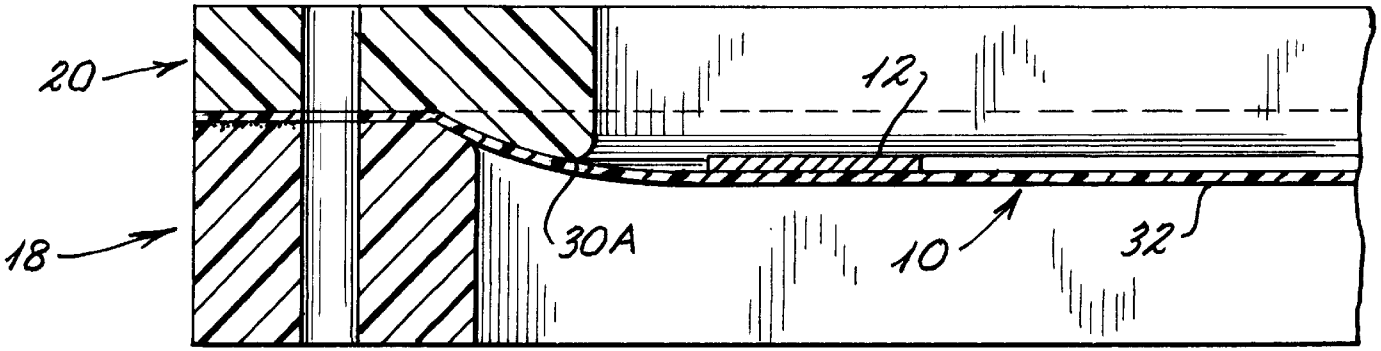
FIG. 6 is a cross-sectional view taken along line 6—6 of FIG. 1 showing modified dimensions of the ridge component of the upper tensioning frame section and the inner edge of the lower frame section of FIG. 2 whereby a decreased amount of tension is being applied along the line of the arrow shown in the drawing figure and representing how the degree of tensioning may be modified by the configuration or profile of the tensioning ridge.

As a modification and in order to allow multi-directional control of the tensioning of a diaphragm within opposing support frame sections, FIG. 6 discloses a ridge member 30A which has a different configuration or profile than that of the ridge shown in FIGS. 1–3. In this embodiment, the ridge is shown as having a gently tapering portion 48 which terminates at a maximum height which is generally equal to the height of the ridge 30 but wherein the ridge is wider and projects slightly further inwardly with respect to the active surface area of the diaphragm. This structure will create a reduced degree of diaphragm elongation than would the ridge 30 of the embodiment of FIGS. 1–3. This may be important, for example, in providing less elongation of the diaphragm during final assembly along lines perpendicular to the elongated axis "A—A" of the diaphragm or at the corners thereof and thereby provide uniform tension throughout the diaphragm.

Figure 7:
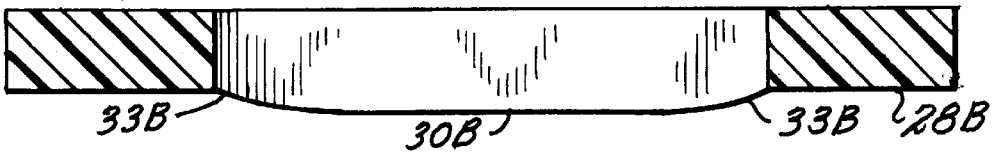
FIG. 7 is a cross-sectional view taken along line 7—7 of FIG. 1 demonstrating a variation of the configuration of the tensioning ridge in a modified embodiment where the ridge tapers to provide substantially zero tension at the corners of the diaphragm when placed between the opposing frame sections.

It should be noted that when a rectangular diaphragm is displaced outwardly along the four edges thereof, a greater degree of deformation is created at the corners of the diaphragm than at the center. Therefore, it is possible that, if the diaphragm is deformed equally at the corners and along the four edges of the diaphragm, the diaphragm may plastically deform or tear. Therefore, in some instances, it may be advisable to taper or profile the ridge, such as shown at 30, so that there is reduced elongation of the diaphragm at the corners. In this respect, FIG. 7 shows the profile of one end of a modified ridge 30B similar to that shown at 30 in FIG. 1 taken along line 7—7 of FIG. 1. In this embodiment, the ridge is profiled in the central portion in a manner similar to that as shown by the ridge 30 in FIGS. 1 and 2. However, the ridge 30B tapers toward the surface 28B of the frame section 20B at the corners and, in some embodiments, may be substantially flush therewith, as shown at 33B in FIG. 7.

To further facilitate the proper and uniform tensioning of the diaphragm 10 between the opposing frame sections 18 and 20, the opposing surfaces and, more particularly, at least the ridge 30 (30A, 30B) is preferably coated with a low friction coating. It is desirable that when the frame sections are assembled with one another, that the amount of friction created between the ridge and the diaphragm be reduced to a minimum to prevent frictional forces which may tend to deform the diaphragm other than by the stretching of the diaphragm. During final assembly, the coated tensioning ridge will urge the diaphragm downwardly with minimal frictional forces being developed between the frame sections that could otherwise change the tensioning characteristics to be developed during final assembly.

It is within the teachings of the present invention that the ridge 30 (30A, 30B) may be further modified so that diaphragm deformation or stretching may vary along the entire length thereof defining the border of the sound producing area 32 of the diaphragm. One method for determining optimum geometry for the configuration of the ridge 30 (30A, 30B) would be to use a simulated frame section, such as shown at 20, provided with a deformable, yet settable, ridge such that, when assembled to an opposing frame section 18 to retain a diaphragm therebetween, the tensioning ridge would deform depending upon the resistance provided by the diaphragm along each portion thereof. In this manner, a casting could be created which could be duplicated to determine the preferred ridge profile or configuration.

In the method of assembly of the present invention, an adhesive 50 is applied to the upper surface border area 25 of the frame section 18. The adhesive may be in the form of a high shear strength double sided adhesive tape. The adhesive may be applied to the entire width of the border area to provide maximum support of the diaphragm. The diaphragm is placed across the frame section 18 and secured thereto at zero plus tension. Thereafter, the registry pins 36 are aligned with the openings 38 in the frame section 18 and the upper frame section lowered to the position shown in FIG. 3. During the lowering, the ridge 30 will force the diaphragm to the proper position and thereby obtain final tensioning of the diaphragm. Suitable fasteners may then be utilized to secure the frame sections in final assembly.

As opposed to initially securing the diaphragm to frame section 18 using adhesive, the diaphragm may be secured using ultrasound, heat staking, crimping, UV curing adhesive or other techniques.

Figure 4:
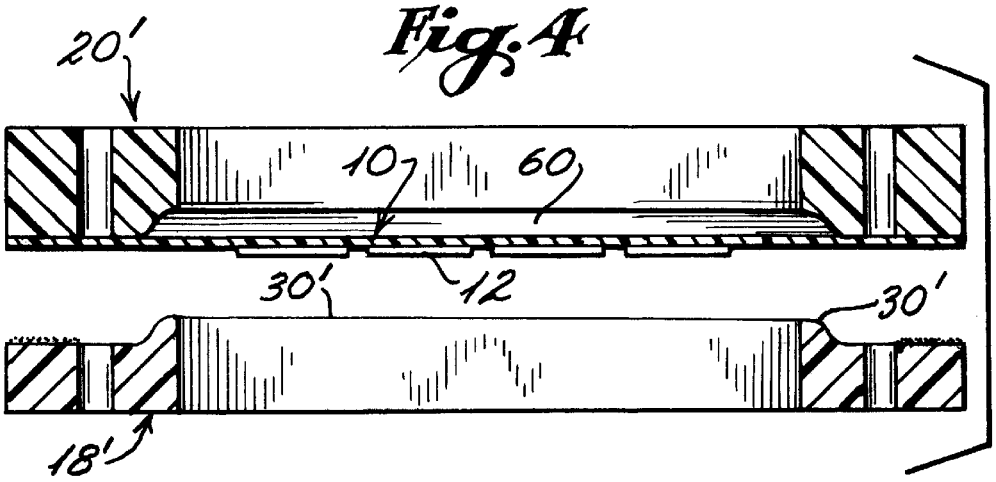
FIG. 4 is a modified view similar to that of FIG. 2 showing the lower frame section provided with a tensioning ridge along the inner edge thereof cooperating with a beveled seat defined along the inner edge of the opposing frame section.
Figure 5:
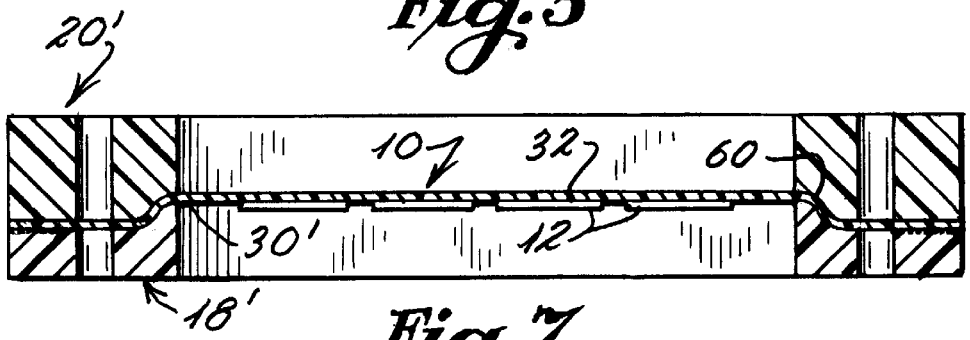
FIG. 5 is a view similar to FIG. 4 showing the upper frame section seated with respect to the lower frame section.

With particular reference to FIGS. 4 and 5, another embodiment of the present invention is disclosed in greater detail. In this embodiment, the lower frame section 18' is provided with an upstanding ridge 30' which defines the border for the internal sound producing area of the diaphragm 10. In this embodiment, the upper frame section 20' includes a recess 60 which extends along the inner edges defining the inner peripheral portion of the frame section. The innermost edge of the ridge 30' aligns with the opening defined by the edge of the recess 60 such that the central areas of both frames are substantially identical. When the frames are assembled in a manner as discussed with respect to the previous embodiment, the border or peripheral surface 28' of the upper frame section will seat with the surface portion 25' of the lower frame section with the ridge 30' partially seated within the recess 60 of the upper frame section. In this embodiment, it is possible to initially apply the diaphragm to a substantial portion of the border surface of either the upper or the lower frame sections before final assembly. During final assembly, the ridge 30' will ensure proper tensioning of the diaphragm. This embodiment, however, is not preferred in that there can be some degree of mechanical binding between the ridge section 30' and the recess 60 as the frame sections are joined and some potential for contaminants to lodge within the recess 60. However, the degree of interference is less than that described above with respect to the prior art and therefore a more uniform tensioning of the diaphragm may be obtained. Again, in the final assembly, the conductors of the diaphragm should preferably be positioned an equal distance between the upper and lower surfaces 45' and 46' of the assembled support frame.

Figure 8:
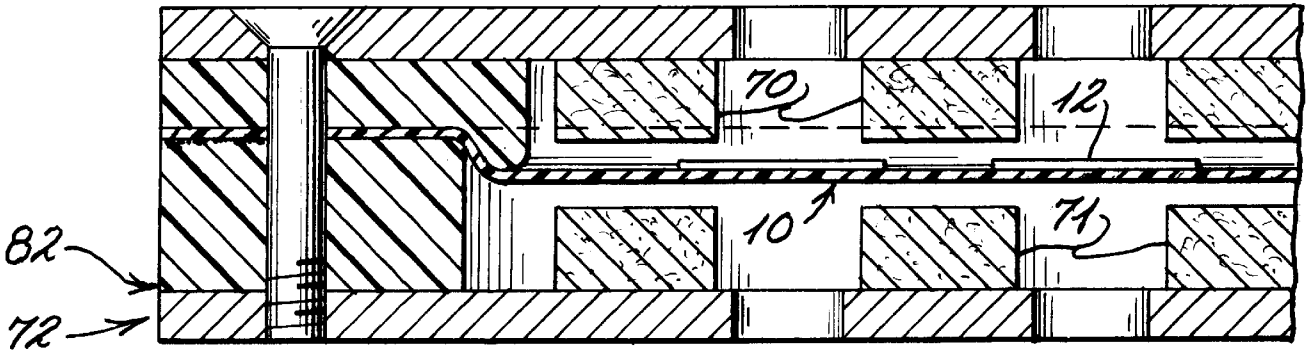
FIG. 8 is a partial cross-sectional view showing a second embodiment of the present invention incorporating a single frame to support both the diaphragm, as shown in FIG. 1, as well as magnets which are utilized in a planar magnetic transducer.

With specific reference to FIG. 8, another embodiment of the invention is shown in a partial cross-sectional view. In this embodiment, the only difference with respect to the frame components are that magnets 70, 71 of a planar magnetic transducer shown at 72 are mounted directly to opposing frame sections 80 and 82. The remaining portions of the frame sections and the manner in which the diaphragm 10 is tensioned is identical to that described with respect to the previous embodiments.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. An acoustic transducer comprising:

a first frame section having a central area surrounded by a peripheral portion;

a second frame section having a central area surrounded by a peripheral portion and having a tensioning ridge extending outwardly from a plane defining the peripheral portion thereof, said tensioning ridge extending along an inner edge of said peripheral portion proximate to said central area thereof;

a planar flexible diaphragm having a peripheral edge portion mounted between said peripheral portions of said first and second frame sections and having a middle sound producing area bordered by said tensioning ridge of said second frame section;

said tensioning ridge of said second frame section extending into said central area of said first frame section to thereby elongate and place tension on said planar flexible diaphragm.

2. The acoustic transducer of claim 1 in which said planar flexible diaphragm is secured to said peripheral portion of said first frame section.

3. The acoustic transducer of claim 2 wherein said planar flexible diaphragm is adhesively secured to said peripheral portion of at least said first frame section.

4. The acoustic transducer of claim 1 including a low friction coating applied to at least said tensioning ridge of said second frame section.

5. The acoustic transducer of claim 1 including registry means for aligning said first and second frame sections relative to one another when seating said first and second frame sections relative to said planar flexible diaphragm.

6. The acoustic transducer of claim 5 in which said registry means includes pin means extending from one of said first and second frame sections and openings in the other of said first and second frame sections for receiving said pin means.

7. The acoustic transducer of claim 1 in which said tensioning ridge is generally continuous defining a border of said sound producing area of said diaphragm.

8. The acoustic transducer of claim 7 including a plurality of first magnets mounted in spaced relationship with respect to one another within said central area of said first frame section, and a second plurality of magnets mounted in spaced relationship with respect to one another within said central area of said second frame section whereby said first and second plurality of magnets are disposed on opposite sides of said planar flexible diaphragm.

9. The acoustic transducer of claim 7 in which said tensioning ridge has varying cross-sectional profiles along the length thereof for purposes of varying the elongation applied at various axes relative to a plane of said planar flexible diaphragm.

10. The acoustic transducer of claim 9 including a plurality of first magnets mounted in spaced relationship with respect to one another within said central area of said first frame section, and a second plurality of magnets mounted in spaced relationship with respect to one another within said central area of said second frame section whereby said first and second plurality of magnets are disposed on opposite sides of said planar flexible diaphragm.

11. The acoustic transducer of claim 8 including a low friction coating applied to at least said tensioning ridge of said second frame section.

12. The acoustic transducer of claim 7 wherein said border defined by said tensioning ridge is generally rectangular in configuration whereby said tensioning ridge defines corner border areas, said tensioning ridge being profiled so as to reduce elongation of said diaphragm at said corner border areas.

13. The acoustic transducer of claim 12 including a plurality of first magnets mounted in spaced relationship with respect to one another within said central area of said first frame section, and a second plurality of magnets mounted in spaced relationship with respect to one another within said central area of said second frame section whereby said first and second plurality of magnets are disposed on opposite sides of said planar flexible diaphragm.

14. The acoustic transducer of claim 12 including a low friction coating applied to at least said tensioning ridge of said second frame section.

15. The acoustic transducer of claim 12 wherein said tensioning ridge tapers to a reduced height adjacent said peripheral portion of said second frame section at said corner border areas.

16. The acoustic transducer of claim 15 including a plurality of first magnets mounted in spaced relationship with respect to one another within said central area of said first frame section, and a second plurality of magnets mounted in spaced relationship with respect to one another within said central area of said second frame section whereby said first and second plurality of magnets are disposed on opposite sides of said planar flexible diaphragm.

17. The acoustic transducer of claim 1 including a plurality of first magnets mounted in spaced relationship with respect to one another within said central area of said first frame section, and a second plurality of magnets mounted in spaced relationship with respect to one another within said central area of said second frame section whereby said first and second plurality of magnets are disposed on opposite sides of said planar flexible diaphragm.

18. The acoustic transducer of claim 17 including a low friction coating applied to at least said tensioning ridge of said second frame section.

* * * * *